US009755361B2

(12) United States Patent
Yamada et al.

(10) Patent No.: US 9,755,361 B2
(45) Date of Patent: Sep. 5, 2017

(54) LEVER OF THE LEVER-FITTING-TYPE CONNECTOR HAVING A LOCKED PART WITH A CONVEX SURFACE

(71) Applicant: YAZAKI CORPORATION, Tokyo (JP)

(72) Inventors: Go Yamada, Shizuoka (JP); Masato Yamagishi, Shizuoka (JP); Hiroshi Shinba, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/297,905

(22) Filed: Oct. 19, 2016

(65) Prior Publication Data

US 2017/0110830 A1 Apr. 20, 2017

(30) Foreign Application Priority Data

Oct. 20, 2015 (JP) ..... 2015-206496

(51) Int. Cl.
*H01R 13/62* (2006.01)
*H01R 13/64* (2006.01)
*H01R 13/629* (2006.01)

(52) U.S. Cl.
CPC . *H01R 13/62938* (2013.01); *H01R 13/62927* (2013.01)

(58) Field of Classification Search
CPC ..... H01R 13/62938; H01R 13/62927; H01R 13/62933; H01R 13/688
USPC ..... 439/342, 372, 157
See application file for complete search history.

(56) References Cited

U.S. PATENT DOCUMENTS 6,755,673 B2 * 6/2004 Fukushima ..... H01R 13/641 439/157
6,982,393 B2 * 1/2006 Matsui ..... H01R 13/62933 200/332
7,625,225 B2 * 12/2009 Mori ..... H01R 13/62938 439/157
8,734,170 B2 * 5/2014 Ikeda ..... H01R 13/62938 439/157
8,834,187 B2 * 9/2014 Furuya ..... H01R 13/62933 439/153
8,986,024 B2 * 3/2015 Ikeda ..... H01H 9/102 200/332
8,992,239 B2 * 3/2015 Furuya ..... H01R 13/62905 439/157
9,028,267 B2 * 5/2015 Furuya ..... H01R 9/16 439/271

(Continued)

FOREIGN PATENT DOCUMENTS

JP 2012059555 A 3/2012

*Primary Examiner* — Hae Moon Hyeon
(74) *Attorney, Agent, or Firm* — Kenealy Vaidya LLP

(57) ABSTRACT

A lever-fitting-type connector includes a housing having a first terminal and a lever having a second terminal. The housing has a locking projection. The locking projection includes a front inclination surface and a rear inclination surface respectively extending along a sliding direction of the lever, and a ridgeline part where the front and rear inclination surfaces are connected to each other. The lever includes a locked part. The locked part has a convex surface. The convex surface, when the lever slides, moves over the ridgeline part from the front inclination surface toward the rear inclination surface.

4 Claims, 9 Drawing Sheets

(56) References Cited

U.S. PATENT DOCUMENTS

| | | | | |
|---|---|---|---|---|
| 9,048,045 | B2 * | 6/2015 | Henmi | H01R 13/62933 |
| 9,130,324 | B2 * | 9/2015 | Furuya | H01R 24/005 |
| 2013/0164959 | A1 | 6/2013 | Furuya et al. | |
| 2016/0365672 | A1 * | 12/2016 | Yamada | H01R 13/62933 |

* cited by examiner

LEVER OF THE LEVER-FITTING-TYPE CONNECTOR HAVING A LOCKED PART WITH A CONVEX SURFACE

CROSS-REFERENCE TO RELATED APPLICATIONS

The present application claims priority from Japanese Patent Application No. 2015-206496 filed on Oct. 20, 2015, the entire content of which is incorporated herein by reference.

FIELD OF INVENTION

The invention relates to a lever-fitting-type connector.

RELATED ART

Conventionally, there is proposed a lever-fitting-type connector including a lever for assisting fitting with partner connector.

For example, one of conventional lever-fitting-type connectors (which is hereinafter called a conventional connector) includes a housing for storing a female terminal, and a lever having a detection terminal for opening and closing (allowing or prohibiting the conduction of) a power circuit with the female terminal and a male terminal of a partner connector connected to each other. In this conventional connector, when a lever is moved to a position (a conduction allowing position; a fitting completed position) where the detection terminal closes the power circuit, a locking part formed in the housing is locked in a hole (locking receiving part) formed in the lever, whereby the position of the lever is fixed (locked) (see, for example, JP-A-2012-059555).

The lever of the conventional connector has a U-shape. The housing is clamped by the lever. In this structure, when the lever moves toward the fitting completed position, the position of the lever changes while the locking part of the housing is pressed against the inside wall surface (the wall surface of the periphery of the hole) of the lever. Therefore, there is a possibility of occurrence of a phenomenon (half-fitting) that the position of the lever is retained even before the locking part is locked in the hole (locking receiving part) of the lever.

The conventional connector is generally structured such that, at the time when the lever reaches the fitting completed position, the detection terminal closes the power circuit (allows conduction). However, depending on the shape, arrangement or the like of the detection terminal, there is a possibility that, even when half-fitting occurs, the power circuit may be closed (conduction can be allowed). In this case, when an external force (such as vibrations) is applied to the lever while the conventional connector in use, since the lever is not fixed, there may be a possibility that the position of the lever is shifted and the power circuit may be opened (conduction is interrupted).

There, an operator to mount the conventional connector onto the partner connector, in order to positively prevent occurrence of the half-fitting, must visually confirm carefully whether the lever exists at the fitting completed position or not. As a result, a step of mounting the conventional connector onto the partner connector is complicated and thus the operation efficiency is hard to be enhanced.

SUMMARY

Exemplary embodiments provide a lever-fitting-type connector capable of enhancing an efficiency of the connector mounting operation.

According to exemplary embodiments, a lever-fitting-type connector includes a housing having a first terminal and a lever having a second terminal. The housing has a locking projection. The locking projection includes a front inclination surface and a rear inclination surface respectively extending along the sliding direction of the lever, and a ridgeline part to which the front and rear inclination surfaces are connected. The lever includes a locked part. The locked part has a convex surface. The convex surface, when the lever slides, moves over the ridgeline part from the front inclination surface toward the rear inclination surface.

DETAILED DESCRIPTION

Description is given below of lever-fitting-type connectors according to embodiments (first and second embodiments) with reference to drawings.

Figure 1:
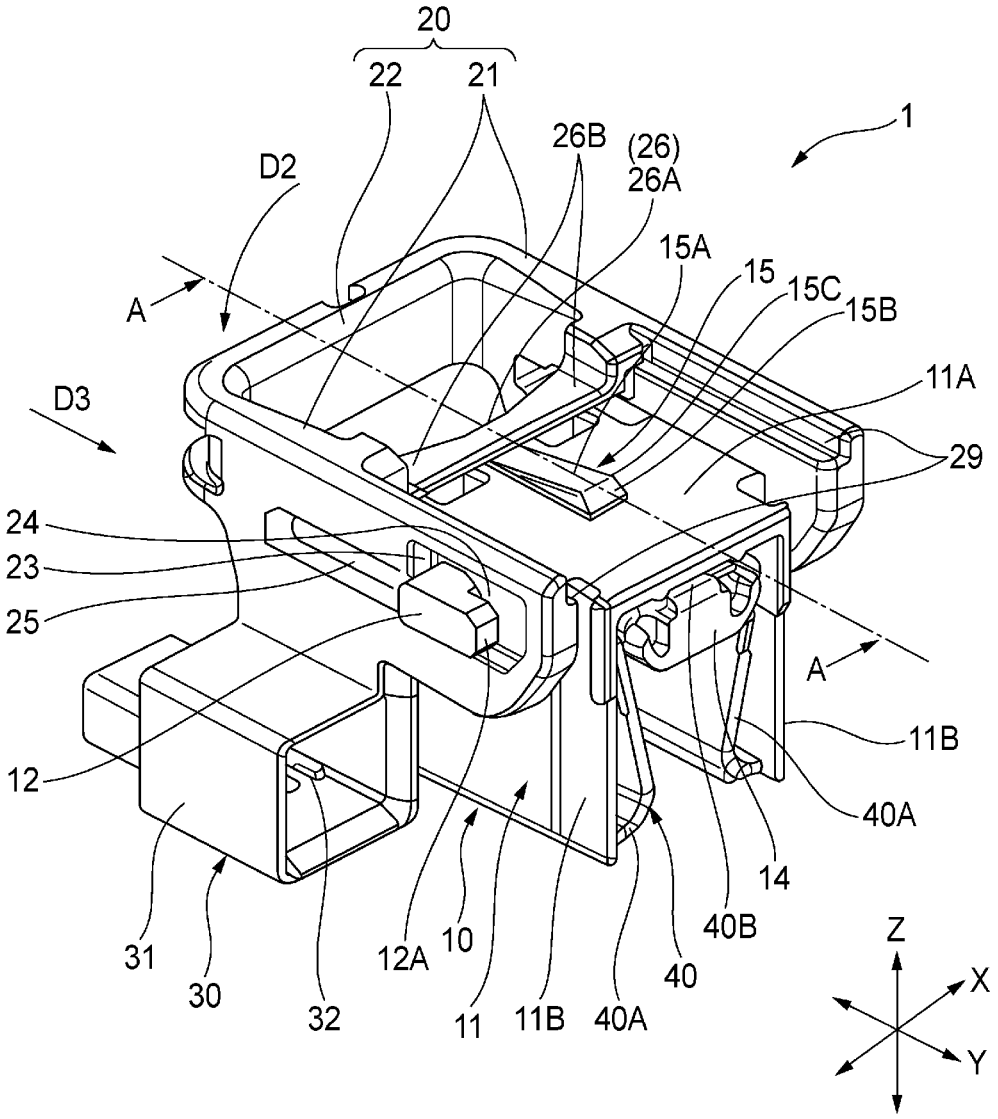
FIG. 1 is a perspective view of a lever-fitting-type connector according to an embodiment, showing a state in which a lever exists at a second position.
Figure 2:
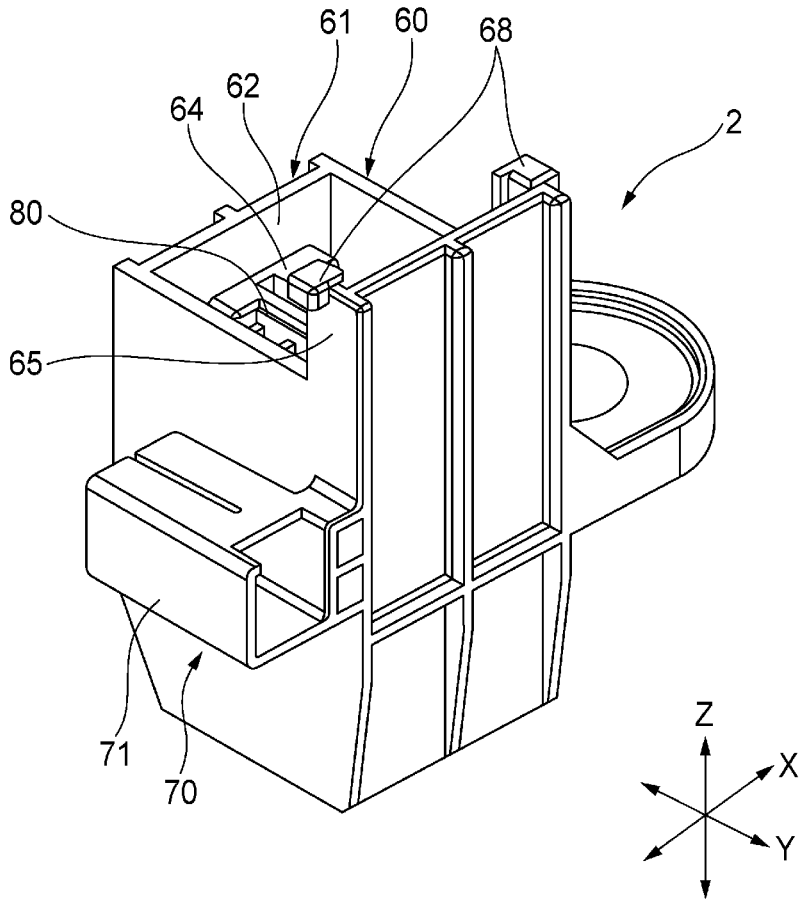
FIG. 2 is a perspective view of the structure of a partner connector of the lever-fitting-type connector shown in FIG. 1.

A lever-fitting-type connector 1 shown in FIG. 1 is fitted and connected to a partner connector 2 shown in FIG. 2. The lever-fitting-type connector 1 is a service plug used in a power circuit breaker provided on an electric vehicle, a hybrid electric vehicle or the like.

As shown in FIG. 1, the lever-fitting-type connector 1 includes a main connector part 10, a lever 20 and a sub-connector part 30. The main connector part 10 and sub-connector part 30 of the lever-fitting-type connector 1 shown in FIG. 1 are respectively fitted and connected to a main connector part 60 and a sub-connector part 70 of a partner connector 2 shown in FIG. 2.

The main connector part 10 of the lever-fitting-type connector 1 has a function to connect or break a power circuit which connects together the high voltage battery and generating motor of the electric vehicle or hybrid electric vehicle. Meanwhile, the sub-connector part 30 has the function of an interlock mechanism to allow or prohibit the conduction of the power circuit.

The lever 20, as described later with reference to FIGS. 3 to 6, is rotatable relative to the main connector part 10 when the main connector part 10 of the lever-fitting-type connector 1 is connected to the main connector part 60 of the partner connector 2. After such connection, the lever 20 is slidable relative to the main connector part 10. The lever 20 has a U-shape including a pair of side plates 21 and a connecting part 22 for connecting together the two side plates 21. On the outer surface of one of the side plates 21 of the lever 20, there is mounted the sub-connector part 30 integrally therewith.

An arrow Z direction in FIG. 1 shows a direction (the fitting direction of the main connector parts 10, 60) where the lever-fitting-type connector 1 and partner connector 2 are brought close to each other and are fitted with each other, an arrow X direction shows a direction perpendicular to the paired side plates 21 of the lever 20, and an arrow Y direction shows a direction (a direction perpendicular to the fitting direction of the main connector parts 10, 60) where the lever 20 slides from a second position to a third position. The X, Y and Z directions are perpendicular to each other.

The main connector part 10 includes a bottom-opened housing 11 having a top wall 11A and two side walls 11B, and a main terminal (first terminal) 40 stored within the housing 11 and supported by a terminal support portion 14. The main terminal 40 has a U-shape including a pair of pressure pieces 40A and a connecting piece 40B connecting together the two pressure pieces 40A. For example, when the main terminal 40 is structured as a fuse, the two terminals of the fuse correspond to the pressure pieces 40A. The main terminal 40, when the main connector part 10 is fitted with the main connector part 60 of the partner connector 2, is connected to the main terminal 80 (see FIG. 2) of the partner connector 2.

On the outer surface of the side wall 11B of the housing 11 opposed to the paired side plates 21 of the lever 20, there are formed a pair of support projecting parts 12. Each support projecting part 12 includes an engaging projection 12A.

Figure 3:
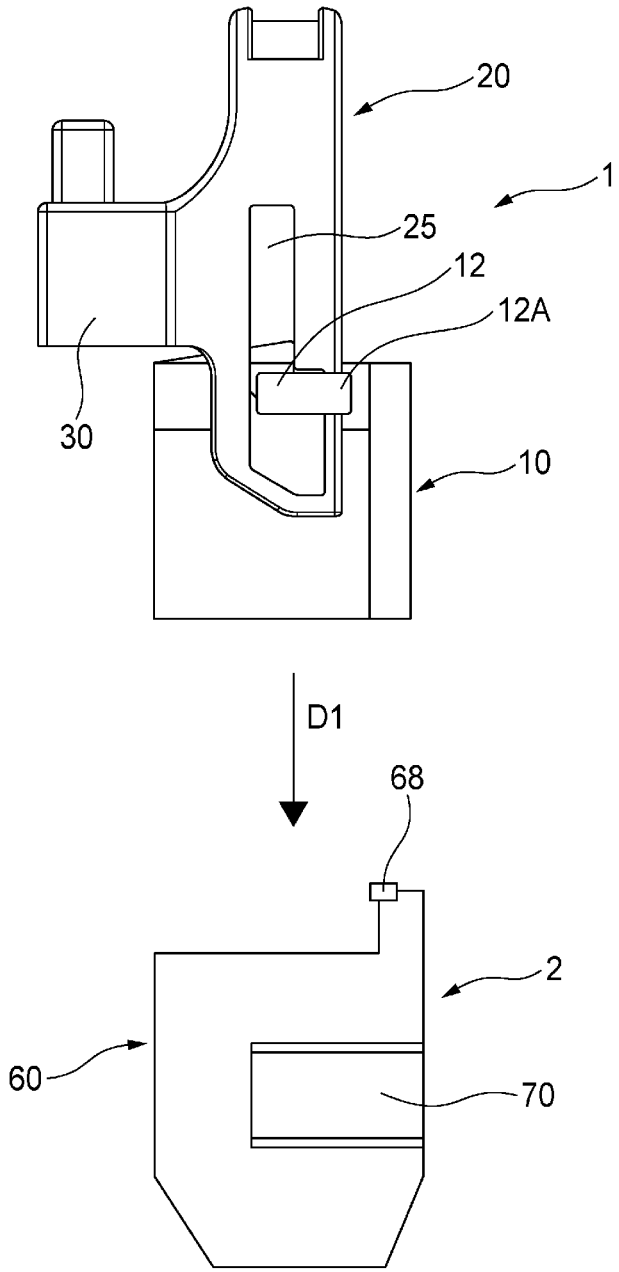
FIG. 3 is a side view of the lever-fitting-type connector of FIG. 1 to explain the procedure for mounting it onto the partner connector, showing a state before the lever-fitting-type connector is fitted with the partner connector (a state where the lever exists at a first position).
Figure 4:
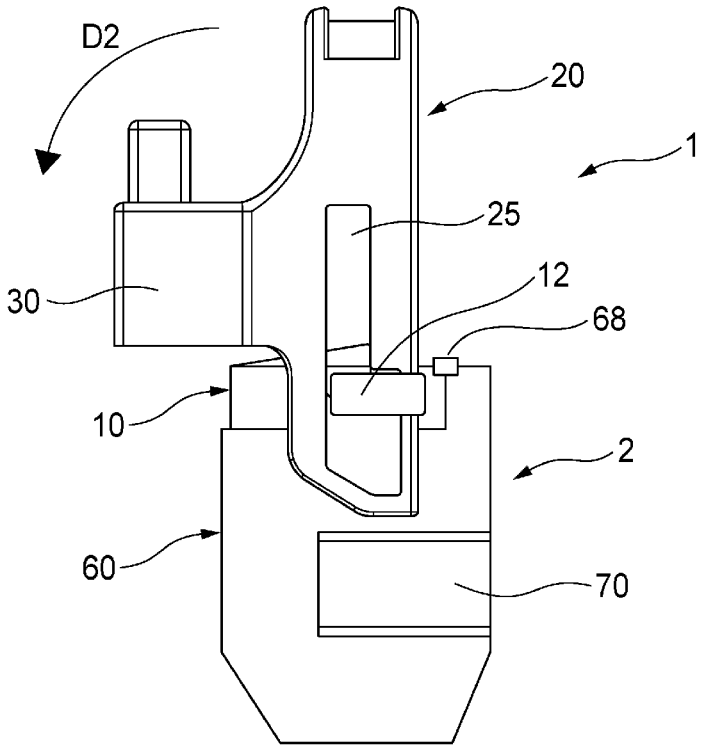
FIG. 4 is a side view of the lever-fitting-type connector of FIG. 1 to explain the procedure for mounting it onto the partner connector, showing a state where the lever-fitting-type connector is fitted with the partner connector (a state where the lever still exists at the first position).
Figure 5:
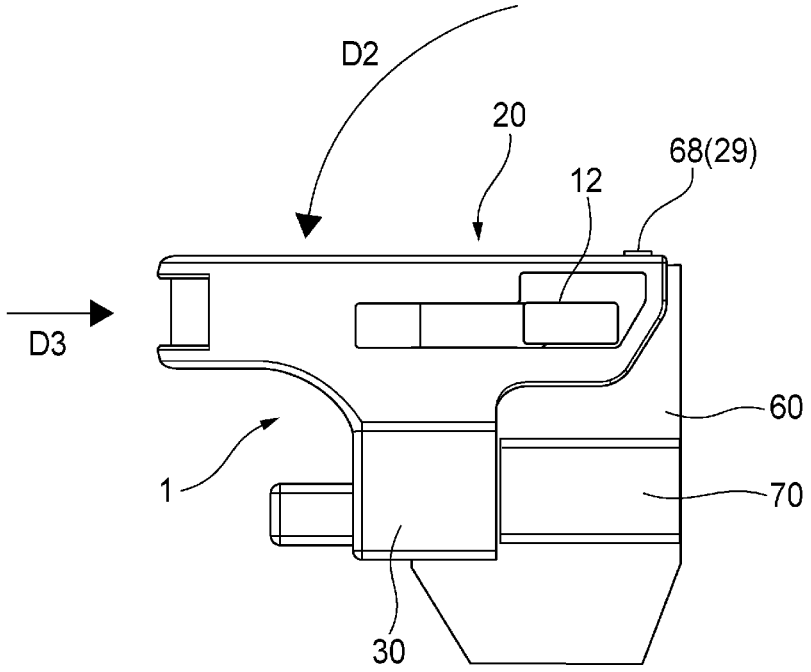
FIG. 5 is a side view of the lever-fitting-type connector of FIG. 1 to explain the procedure for mounting it onto the partner connector, showing a state where the lever of the lever-fitting-type connector is rotated from the first position to the second position.

The side plate 21 of the lever 20 includes: a support hole 23 with the support projecting part 12 inserted therein; an engaging part 24 which, when engaged with the engaging projection 12A, selectively regulates the rotation-direction position of the lever 20 to a position (first position) shown in FIGS. 3, 4 or a position (second position) shown in FIG. 5; and, a slide groove 25 formed continuous with the support hole 23. The support hole 23 is situated in one end of the slide groove 25. Thus, while the support projecting part 12 is fitted in the support hole 23, the lever 20 can rotate relative to the housing 11; and, when the support projecting part 12 is disengaged from the support hole 23 and is moved to the slide groove 25, the lever 20 is prevented from rotating relative to the housing 11 and is only allowed to slide.

Figure 6:
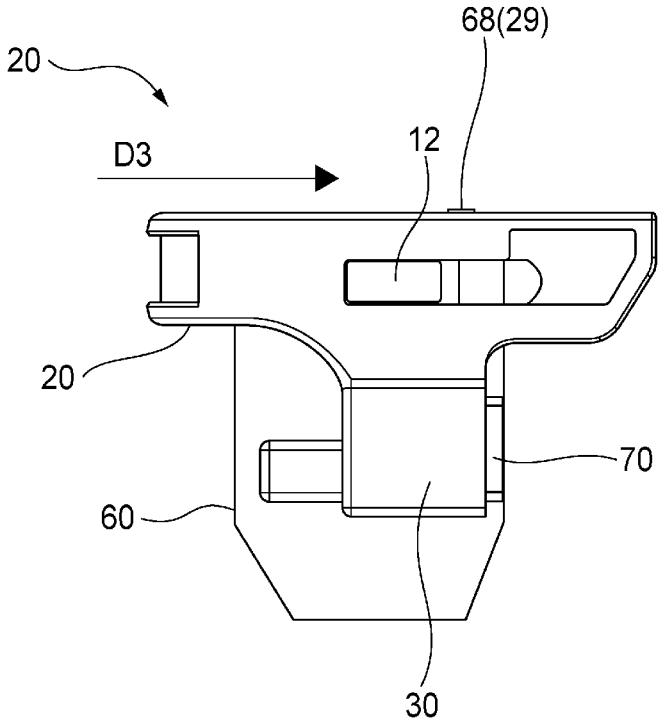
FIG. 6 is a side view of the lever-fitting-type connector of FIG. 1 to explain the procedure for mounting it onto the partner connector, showing a state where the lever is slid from the second position to the third position.

The sub-connector part 30 includes a cylindrical sub-housing 31 the fitting direction of which is set along the sliding direction of the lever 20, and a sub-terminal (second terminal) 32 disposed within the sub-housing 31. The sub-connector part 30, when the lever 20 is slid from the position (second position) shown in FIG. 5 to a position (third position) shown in FIG. 6, is fitted with the sub-connector part 70 of the partner connector 2. The sub-terminal 32 is a terminal which, when the sub-connector part 30 is fitted with the sub-connector part 70 of the partner connector 2, is connected to the sub-terminal (not shown) of the partner connector 2.

Further, as shown in FIG. 1, on the upper surface of the top wall 11A of the housing 11, there is provided a locking projection 15 for locking the lever 20 when the lever 20, as shown by the arrow D3, slides from the position (second position) shown in FIG. 5 toward the position (third position) shown in FIG. 6.

Figure 7:
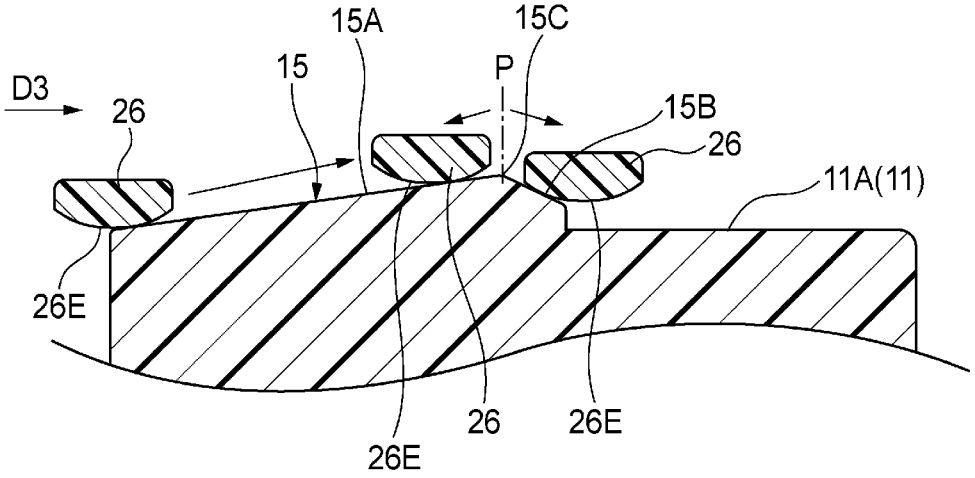
FIG. 7 is a section view of the lever-fitting-type connector of FIG. 1, taken along the A-A arrow shown in FIG. 1.
Figure 8:
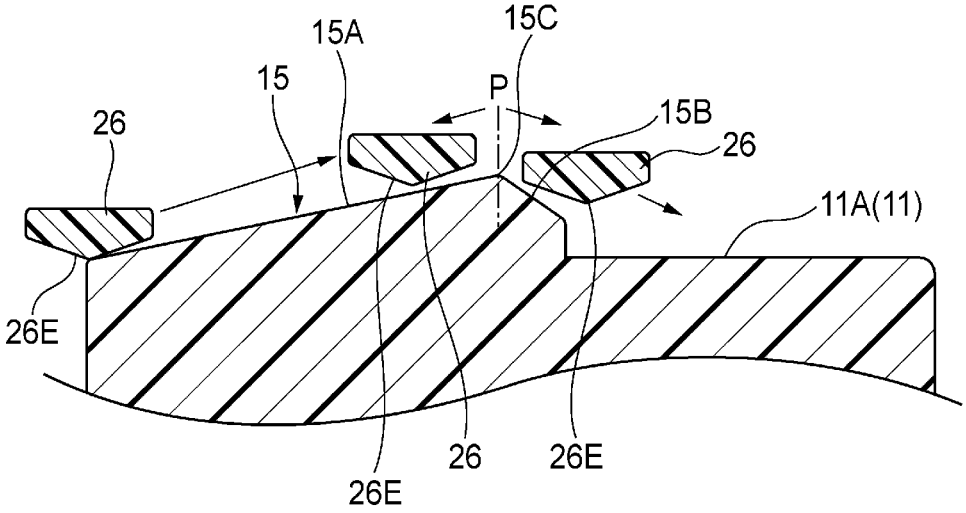
FIG. 8 is a view of a modification of the lever-fitting-type connector of FIG. 1.

The locking projection 15 is arranged in the middle position of the X-direction width of the top wall 11A of the housing 11 and, as shown in FIGS. 7 and 8, has an angular shape including a front inclination surface 15A and a rear inclination surface 15B respectively extending along the sliding direction of the lever 20 (the arrow D3 direction), and a ridgeline part 15C connecting together the front and rear inclination surfaces 15A and 15B.

The front inclination surface 15A is upwardly inclined along the sliding direction (the arrow D3 direction) and the rear inclination surface 15B is downwardly inclined along the sliding direction (the arrow D3 direction), while the ridgeline part 15C provides a vertex part (a boundary point P between the upward and downward inclination surfaces). Here, in the sliding direction (the arrow D3 direction) of the lever 20, the length of the front inclination surface 15A is set longer than that of the rear inclination surface 15B.

The lever 20 includes a slat-shaped locked part 26. The slat-shaped locked part 26 is a both-ends supported beam-like part which is extended between the two side plates 21 of the lever 20, the two ends 26B of which are fixed to the two side plates 21 and are formed wide in width, and the middle portion 26A of which is formed narrow in width so as to be easily flexed when the part 26 presses against and slides on the locking projection 15. The locked part 26, when the lever 20 slides as shown by the arrow D3 from the position (second position) shown in FIG. 5 toward the position (third position) shown in FIG. 6, moves while pressing the convex surface 26E of the lower surface thereof against the locking projection 15 of the housing 11, and is elastically deformed (flexibly deformed) in a direction perpendicular to the sliding direction according to such pressing force.

The convex surface 26E of the lower surface of the locked part 26, when the lever 20 reaches the position (third position) shown in FIG. 6, moves over the ridgeline part 15C from the front inclination surface 15A toward the rear inclination surface 15B. Here, the section shape of the convex surface 26E of the lower surface of the locked part 26 may be, for example, an arc shape shown in FIG. 7 or a triangular shape shown in FIG. 8.

As shown in FIG. 7, in the case that the section shape of the convex surface 26E is formed as an arc-like shape, when the section shape of the ridgeline part (vertex part) 15C of the locking projection 15 is also formed as an arc-like shape, a click feeling when the locking part 26 moves over the locking projection 15 can be decreased. Meanwhile, as shown in FIG. 8, in the case that the section shape of the convex surface 26E is formed as a triangular shape, when the section shape of the ridgeline part (vertex part) 15C of the locking projection 15 is also formed as a triangular shape, such click feeling can be increased.

Further, as shown in FIG. 1, the lever 20 includes, in the end edge on the opposite side of the connecting part 22, engaging grooves 29 to be engaged with the engaging projecting parts 68 (see FIG. 2) of the partner connector 2.

The main connector part 60 of the partner connector 2 includes a cylindrical-shaped housing 61 having an internal space serving as a fitting opening 62 to be fitted by the main connector part 10 of the lever-fitting-type connector 1, and a main terminal 80 supported by a terminal support portion 64 formed within the cylindrical housing 61. Meanwhile, the sub-connector part 70 includes a sub-housing 71 having an opening facing in a direction perpendicular to the opening direction of the cylindrical housing 61 of the main connector part 10, and a sub-terminal (not shown) held within the sub-housing 71. The fitting direction (Z direction) of the main connector part 60 of the partner connector 2 and the fitting direction (Y direction) of the sub-connector part 70 are perpendicular to each other.

The housing 61 of the main connector part 60 includes a projecting wall 65 on the end thereof, and the engaging projecting parts 68 are formed in the leading end of the projecting wall 65. The engaging projecting parts 68, when the lever 20 rotates, are engaged into the engaging grooves 29 of the lever 20. As the lever 20 rotates with the engaging parts 68 as the fulcrums, due to the leverage action generated by the rotation operation of the lever 20, there is applied a force which brings the main connector part 10 into engagement with the support projecting part 12 functioning as a point of action.

When connecting the lever-fitting-type connector 1 to the partner connector 2, firstly, as shown in FIGS. 3 and 4, in a state where the lever 20 stands erect (is held at the first position), as shown by the arrow D1, the main connector part 10 of the lever-fitting-type connector 1 is brought close to the main connector part 60 of the partner connector 2, whereby the engaging projecting part 68 of the partner connector 2 is ready to be engageable when the lever 20 rotates.

Next, the erect lever 20 is rotated as shown by the arrow D2 and is thereby pushed down to a position (second position) as shown in FIG. 5. In this case, the lever 20 rotates with the engaging projecting part 68 of the partner connector 2 as the fulcrum, whereby, due to the principle of leverage, the main connector part 10 of the lever-fitting-type connector 1 is fitted with the main connector part 60 of the partner connector 2. In this stage, although the main terminals 40 and 80 are mechanically connected to each other, since the sub-terminals 32 are not connected, the battery power circuit remains interrupted.

Next, in a state where the lever 20 is rotated and is thereby fallen down, as shown in FIG. 6, the lever 20 is slid to the third position as shown by the arrow D3. Thus, the sub-connector part 30 of the lever-fitting-type connector 1 is fitted with the sub-connector part 70 of the partner connector 2 and the sub-terminals 32 for interlocking are connected to each other, thereby providing a state where the conduction of the power circuit is allowed.

In this case, since the locked part 26 of the lever 20 is engaged with the locking projection 15 provided on the housing 11, the lever 20 is locked.

More specifically, as shown in FIGS. 7 and 8, the locking projection 15 has an angular shape (a shape including the front inclination surface 15A, rear inclination surface 15B and ridgeline part 15C), whereas the locked part 26 of the lever 20 has a shape including the convex surface 26E. Therefore, with the sliding movement of the lever 20, the locking projection 15 and locked part 26, when they are pressure contacted with each other, are not surface contacted with each other but are line or point contacted. Thus, when compared with a surface contact case, the frictional force of the contact parts is reduced and, accordingly, there is reduced a possibility that the locked part 26 can be made to stand still on the inclination surface of the locking projection 15 (that is, half-fitting occurs).

For example, when the sliding operation is interrupted in the middle of the front inclination surface 15A of the locking projection 15 (that is, when, in that stage, application of an external force in the sliding direction is removed), due to a force by which the locked part 26 presses against the locking projection 15, a force going down on the front inclination surface 15A is applied to the locked part 26. As a result, the locked part 26 (and thus the lever 20) is naturally returned in the reverse direction to the sliding direction.

Meanwhile, when the sliding operation is interrupted in the middle of the rear inclination surface 15B of the locking projection 15 (that is, when, in that stage, application of an external force in the sliding direction is removed), due to a force by which the locked part 26 presses against the locking projection 15, a force going down on the rear inclination surface 15B (the same direction as the sliding direction) is applied to the locked part 26. As a result, the locked part 26 (and thus the lever 20) is naturally moved in the sliding direction, whereby the locked part 26 is locked to the locking projection 15.

As described above, in the lever-fitting-type connector 1 of this structure, in the state where half-fitting can occur (when the locked part 26 exists in the middle of the front inclination surface 15A), the lever position is naturally returned toward the second position. Thus, such movement of the lever 20 can easily notify an operator of half-fitting. Further, when the locked part 26 moves over the ridgeline part 15C (when the locked part 26 exists in the middle of the rear inclination surface 15B), the lever 20 quickly moves toward the third position. Thus, such movement of the lever 20 can provide the click feeling of the perfect-fitting time. As a result, when compared with the conventional connector, the operator can recognize the fitting state of the connector (whether half-fitting or not) more easily, thereby enabling contribution to enhancement in the efficiency of the connector mounting operation.

Further, since the front inclination surface 15A is longer that the rear inclination surface 15B, when the sliding operation is interrupted before the lever reaches the complete fitting position (when, in the stage where the locked part 26 exists in the middle of the front inclination surface 15A of the locking projection 15, the sliding operation is interrupted), the push-back distance of the lever 20 is increased. In addition, since the rear inclination surface 15B is shorter than the front inclination surface 15A, when the locked part 26 moves over the ridgeline part 15C of the locking projection 15, the lever 20 moves quickly to the final position (the rear end of the rear inclination surface). This can facilitate recognition of the operator as to the fact that perfect fitting is not attained and also, when perfect-fitting is attained, the click feeling can be provided easily.

Further, since the locked part 26 is structured as the both-ends supported beam, when elastically deformed, the restoring force thereof is large, thereby increasing a force for pushing back the lever 20 before perfect-fitting. This can facilitate recognition of the operator as to whether perfect-fitting is attained or not. In addition, since the contact angle of the locked part 26 with the locking projection 25 hardly changes when it is elastically deformed, design can be facilitated.

Here, the invention is not limited to the above embodiments but various modifications may be employed within the range of the invention. That is, the invention is not limited to the above embodiment but proper modification, improvements and so on would be possible. Also, the materials, shapes, dimensions, number, arrangement positions and so on of the respective composing elements in the above embodiments may be arbitrary and not imitative so long as they may attain the invention.

Figure 9:
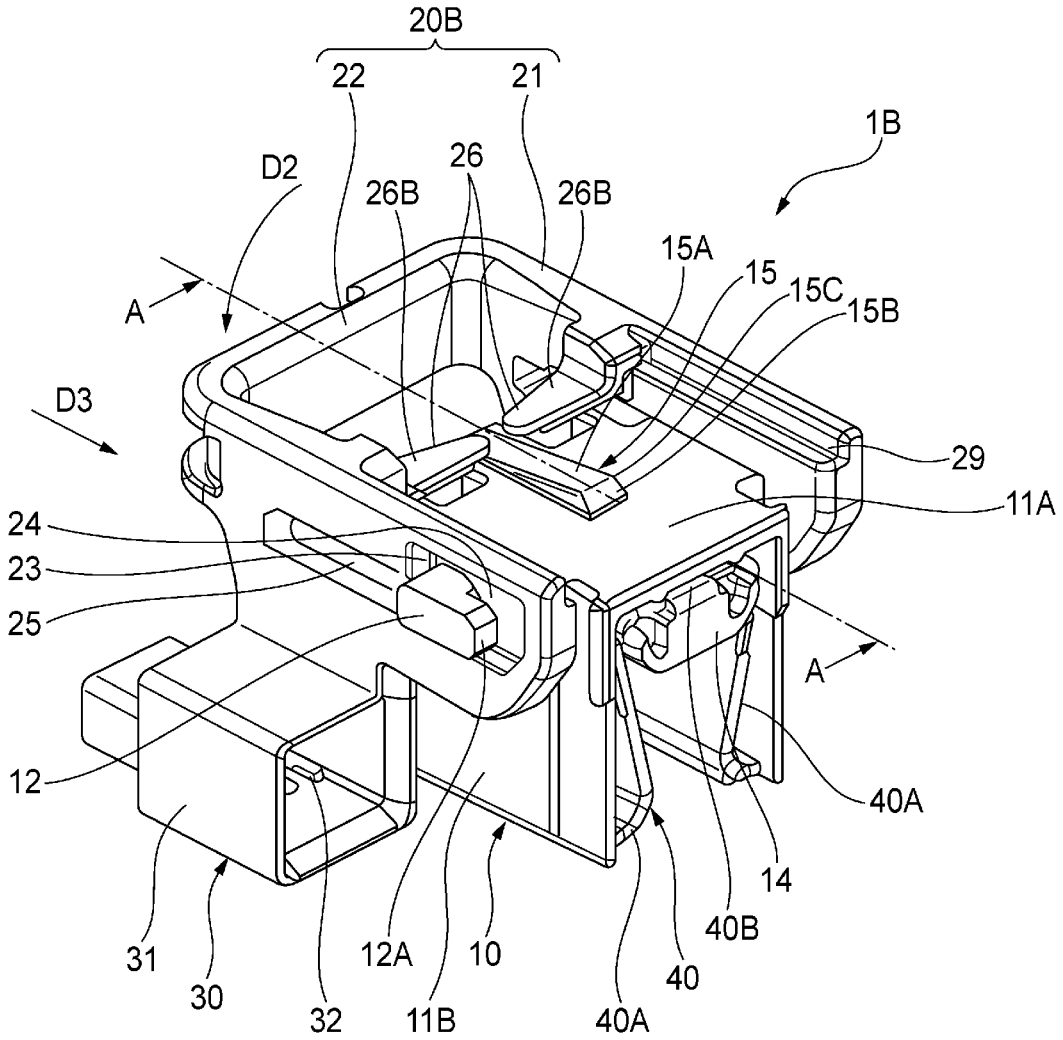
FIG. 9 is a perspective view of a lever-fitting-type connector according to another embodiment, showing a state in which a lever exists at a second position.

For example, in the above embodiments, the locked part 26 of the lever 20 has the shape of a both-ends-supported beam. However, like a lever-fitting-type connector 1B of another embodiment shown in FIG. 9, the locked part 26 of the lever 20B may also have the shape of a cantilevered beam.

When the locked part 26 of the lever 20B is structured to have the shape of a cantilevered beam, when compared with the both-ends-supported beam, the part 26 is easy to elastically deform in contact with the locking projection 15. Therefore, when the lever 20B is operated to slide, when compared with the above embodiment (the both-ends-supported beam), the lever 20B can be moved with a small force, thereby enabling enhancement in operation efficiency. However, when the locked part 26 has the shape of a cantilevered beam, as the lever 20B slides, the contact angle of the locked part 26 with the locking projection 15 changes, thereby raising a possibility that that design of the shapes of the locked part 26 and locking projection 15 can be made slightly harder.

According to the embodiments of the invention, the lever-fitting-type connector comprises: a housing (11) having a first terminal (40); and, a lever (20) having a second terminal (32), the lever, in a first position thereof (a position shown in FIGS. 3 and 4), being capable of connecting the first terminal (40) to the corresponding terminal of a partner connector, and, when it is rotated by a specific angle around the housing from the first position to a second position (a position shown in FIG. 5) and is thereafter slid from the second position to a third position (a position shown in FIG. 6), being capable of connecting together the second terminal (32) and the corresponding terminal of the partner connector.

The housing (11) includes a front inclination surface (15A) and a rear inclination surface (15B) respectively extending along a sliding direction where the lever (20) slides from the second position toward the third position, and a ridgeline part (15C) where the front inclination surface (15A) and rear inclination surface (15B) are connected to each other.

The lever (20) includes a locked part 26.

The locked part (26) has a convex surface (26E) and is structured such that, when the lever (20) slides from the second position toward the third position, moves while pressing the convex surface (26E) against the locking projection (15).

The convex surface (26E) is structured such that, when the lever reaches the third position, it moves over the ridgeline part (15C) from the front inclination surface (15A) toward the rear inclination surface (15B).

According to the lever-fitting-type connector having the above structure, the locking projection provided on the housing has an angular shape (a shape including the front inclination surface, rear inclination surface and ridgeline part), whereas the locked part (slat structure) formed in the lever has a convex surface shape. Therefore, the locking projection and locked part, when they are pressure contacted with each other, are not surface contacted but are line or point contacted. Thus, when compared with a case where they are surface contacted, a frictional force in their contact position is small and, accordingly, there is reduced a possibility that the locked part stands still on the inclined surface of the locking projection (that is, half-fitting occurs).

More specifically, in the case that, when the locked part exists in the middle of the front inclination surface, the sliding operation is interrupted, due to a force by which the locked part presses against the locking projection, a force in a direction going down on the front inclination surface is applied to the locked part. As a result, the locked part (and thus the lever) is naturally returned reversely to the sliding direction.

Meanwhile, in the case that, when the locked part exists in the middle of the rear inclination surface, the sliding operation is interrupted, due to a force by which the locked part presses against the locking projection, a force in a direction going down on the front inclination surface is applied to the locked part. As a result, the locked part (and thus the lever) is naturally moved in the same direction as the sliding direction, thereby locking the locked part to the locking projection.

As described above, according to the lever-fitting-type connector of this structure, when there is a possibility the half-fitting may occur (when the locked part exists in the middle of the front inclination surface), the lever position is naturally returned toward the second position. Thus, such movement of the lever would facilitate recognition of half-fitting by the operator. Further, when the locked part moves over the ridgeline part (when the locked part exists in the middle of the rear inclination surface), the lever moves quickly toward the third position. Such movement of the lever would provide a click feeling when perfect-fitting is attained.

Therefore, when compared with the conventional connector, the above-structured lever-fitting-type connector would facilitate recognition of the fitting state (whether half-fitting is occurring or not) of the connector by the operator, thereby enabling enhancement in the operation efficiency when mounting the connector.

In the sliding direction of the lever (20), the length of the front inclination surface (15A) may be longer than that of the rear inclination surface (15B).

According to this structure, since the front inclination surface is longer than the rear inclination surface, in the case that, when the locked part exists in the middle of the front inclination surface, the sliding movement is interrupted (in a state where half-fitting can occur), the lever push-back length is increased, and in the case that, when the locked part exists in the middle of the rear inclination surface (when the locked part moves over the ridgeline part), the lever moves quickly to the third position. This makes it easy for an operator to recognize that perfect-fitting is not attained and, when perfect-fitting is attained, the click feeling may be obtained easily.

The locked part (26) may also have the shape of a cantilevered beam (the shape shown in FIG. 9) extending from the lever. The locked part (26) to be locked may also have the shape of a both-ends supported beam (the shape shown in FIG. 1) extending from the lever.

According to this structure, in the case that the locked part is constituted of a cantilevered beam, in comparison with a case where it is constituted of a both-ends supported beam, when the locked part is contacted with the locking projection, it is easy to flex. Therefore, in sliding the lever, when compared with a case where the locked part is constituted of a both-ends supported beam, it can be moved with a small force, thereby providing excellent operation efficiency. However, in the case of a cantilevered beam, since, with the sliding movement of the lever, the contact angle of the locked part with the locking projection changes, there is a possibility that design of the locked part and locking projection can be rather difficult. Meanwhile, in the case of a both-ends supported beam, in comparison with a cantilevered beam, since the locked part is hard to flex, in a state where half-fitting can occur, the lever push-back force is increased. This makes it easy for the operator to recognize whether perfect-fitting is attained or not. Further, since, even when the lever slides, the contact angle of the locked part with the locking projection hardly changes, design of the locked part and locking projection is easy. However, in the case of a both-ends supported beam, there is a possibility that operation efficiency can be worsened by an amount corresponding to the increased lever push-back force.

According to the embodiments, there is provided a lever-fitting-type connector capable of enhancing the efficiency of the connector mounting operation. According to the lever-fitting-type connector of the embodiments, the operator may more easily recognize the fitting state of the connector (whether it is in a half-fitting state or not), thereby enabling contribution toward enhancement in the connector mounting operation.

DESCRIPTION OF REFERENCE NUMERALS AND SIGNS

1: Lever-fitting-type connector
2: Partner connector
11: Housing
15: Locking projection
15A: Front inclination surface
15B: Rear inclination surface
15C: Ridgeline part
20: Lever
26: Locked part
32: Sub-terminal (second terminal)
40: Main terminal (first terminal)

What is claimed is:

1. A lever-fitting-type connector comprising:

a housing including a first terminal; and a lever including a second terminal, wherein the lever is configured to connect the first terminal to a corresponding main terminal of a partner connector when the lever is in a first position, and to connect the second terminal to a corresponding sub-terminal of the partner connector when the lever slides from a second position to a third position after the lever is rotated by a predetermined angle around the housing from the first position to the second position, wherein the housing includes a locking projection having a front inclination surface and a rear inclination surface respectively extending along a sliding direction of the lever from the second position toward the third position and a ridgeline part where the front inclination surface and the rear inclination surface are connected to each other, wherein the lever includes a locked part, wherein the locked part has a convex surface, and the locked part is configured to move while pressing the convex surface to the locking projection when the lever slides from the second position to the third position, and wherein the convex surface is configured to move over the ridgeline part from the front inclination surface to the rear inclination surface when the lever reaches the third position.

2. The lever-fitting-type connector according to claim 1, wherein a length of the front inclination surface in the sliding direction of the lever is longer than a length of the rear inclination surface in the sliding direction of the lever.

3. The lever-fitting-type connector according to claim 1, wherein the locked part has a shape of a cantilevered beam extending from the lever or a shape of a both-ends supported beam extending from the lever.

4. The lever-fitting-type connector according to claim 2, wherein the locked part has a shape of a cantilevered beam extending from the lever or a shape of a both-ends supported beam extending from the lever.

* * * * *